US010284961B2

(12) United States Patent
Margalit

(10) Patent No.: US 10,284,961 B2
(45) Date of Patent: May 7, 2019

(54) MEMS-BASED STRUCTURE FOR PICO SPEAKER

(71) Applicant: EMPIRE TECHNOLOGY DEVELOPMENT LLC, Wilmington, DE (US)

(72) Inventor: Mordehai Margalit, Zichron Yaaqov (IL)

(73) Assignee: Empire Technology Development LLC, Wilmington, DE (US)

( * ) Notice: Subject to any disclaimer, the term of this patent is extended or adjusted under 35 U.S.C. 154(b) by 431 days.

(21) Appl. No.: 15/117,169

(22) PCT Filed: Feb. 8, 2014

(86) PCT No.: PCT/US2014/015438
§ 371 (c)(1),
(2) Date: Aug. 5, 2016

(87) PCT Pub. No.: WO2015/119626
PCT Pub. Date: Aug. 13, 2015

(65) Prior Publication Data

US 2016/0360321 A1 Dec. 8, 2016

(51) Int. Cl.
*H04R 25/00* (2006.01)
*H04R 19/02* (2006.01)
(Continued)

(52) U.S. Cl.
CPC ..... *H04R 19/02* (2013.01); *G10K 11/22* (2013.01); *H04R 7/10* (2013.01); *H04R 19/005* (2013.01);
(Continued)

(58) Field of Classification Search
USPC ..... 381/174, 191; 310/316.01
See application file for complete search history.

(56) References Cited

U.S. PATENT DOCUMENTS 3,939,467 A 2/1976 Cook et al.
5,000,000 A * 3/1991 Ingram ..... C12N 15/52 435/161
(Continued)

FOREIGN PATENT DOCUMENTS

EP 1737266 A1 12/2006
EP 2271129 A1 1/2011
(Continued)

OTHER PUBLICATIONS

Feiertag, G., et al.,"Determining the acoustic resistance of small sound holes for MEMS microphones." Procedia Engineering, vol. 25, pp. 1509-1512 (2011).
(Continued)

*Primary Examiner* — Phylesha Dabney

(57) ABSTRACT

Techniques described herein generally include methods and systems related to a MEMS-based audio speaker system that includes a first movable element, formed from a first layer of a semiconductor substrate, and a second movable element, formed from a second layer of the semiconductor substrate that is a different layer than the first layer of the semiconductor substrate. The first movable element may be configured to oscillate along a first directional path substantially orthogonal to the first plane.

28 Claims, 9 Drawing Sheets

(51) Int. Cl.
*H04R 19/00* (2006.01)
*H04R 7/10* (2006.01)
*G10K 11/22* (2006.01)

(52) U.S. Cl.
CPC .... *H04R 2201/003* (2013.01); *H04R 2217/03* (2013.01)

(56) References Cited

U.S. PATENT DOCUMENTS

| | | | | |
|---|---|---|---|---|
| 5,889,870 | A | 3/1999 | Norris | |
| 6,229,899 | B1 | 5/2001 | Norris et al. | |
| 6,315,462 | B1 | 11/2001 | Anthamatten et al. | |
| 6,388,359 | B1 | 5/2002 | Duelli et al. | |
| 6,577,738 | B2 | 6/2003 | Norris et al. | |
| 6,584,205 | B1 | 6/2003 | Croft, III et al. | |
| 6,606,389 | B1 | 8/2003 | Selfridge et al. | |
| 6,612,029 | B2 * | 9/2003 | Behin | B81B 3/0021 29/830 |
| 6,619,813 | B1 | 9/2003 | Schnell | |
| 6,631,196 | B1 | 10/2003 | Taenzer et al. | |
| 6,678,381 | B1 | 1/2004 | Manabe | |
| 6,771,001 | B2 | 8/2004 | Mao et al. | |
| 6,778,672 | B2 | 8/2004 | Breed et al. | |
| 6,925,187 | B2 | 8/2005 | Norris et al. | |
| 7,005,776 | B1 * | 2/2006 | Iino | H01L 41/0913 310/316.01 |
| 7,327,547 | B1 * | 2/2008 | Epstein | H05K 9/0079 361/212 |
| 7,502,486 | B2 | 3/2009 | Shin et al. | |
| 7,747,029 | B2 | 6/2010 | Kim et al. | |
| 7,881,489 | B2 | 2/2011 | Matsuzawa et al. | |
| 7,945,059 | B2 | 5/2011 | Miyazaki | |
| 7,961,900 | B2 | 6/2011 | Zurek et al. | |
| 8,079,246 | B2 * | 12/2011 | Garmire | B81C 99/005 324/750.3 |
| 8,428,278 | B2 * | 4/2013 | Lastrucci | H04R 9/06 381/107 |
| 9,913,048 | B2 * | 3/2018 | Margalit | H04R 19/005 |
| 10,123,126 | B2 * | 11/2018 | Margalit | H04R 1/24 |
| 2001/0034938 | A1 | 11/2001 | Behin et al. | |
| 2003/0218793 | A1 * | 11/2003 | Soneda | G02B 6/3518 359/291 |
| 2006/0094988 | A1 | 5/2006 | Tosaya et al. | |
| 2006/0291667 | A1 | 12/2006 | Watanabe et al. | |
| 2007/0050441 | A1 | 3/2007 | Taenzer et al. | |
| 2008/0013761 | A1 | 1/2008 | Matsuzawa et al. | |
| 2008/0187154 | A1 * | 8/2008 | Martin | H04R 19/005 381/174 |
| 2008/0205195 | A1 | 8/2008 | Van Der Merwe | |
| 2008/0226096 | A1 | 9/2008 | Waddell et al. | |
| 2008/0267431 | A1 | 10/2008 | Leidl et al. | |
| 2008/0285777 | A1 | 11/2008 | Pompei | |
| 2009/0152980 | A1 | 6/2009 | Huang | |
| 2010/0080409 | A1 | 4/2010 | Xu et al. | |
| 2010/0098274 | A1 | 4/2010 | Hannemann et al. | |
| 2010/0264777 | A1 | 10/2010 | Medhat et al. | |
| 2010/0289717 | A1 | 11/2010 | Arslan et al. | |
| 2010/0315696 | A1 * | 12/2010 | Lee | G02B 26/001 359/290 |
| 2011/0115337 | A1 | 5/2011 | Nakamura et al. | |
| 2011/0122731 | A1 | 5/2011 | Buccafusca et al. | |
| 2011/0123043 | A1 | 5/2011 | Felberer et al. | |
| 2011/0182150 | A1 | 7/2011 | Cohen et al. | |
| 2012/0014525 | A1 | 1/2012 | Ko et al. | |
| 2012/0017693 | A1 | 1/2012 | Robert et al. | |
| 2012/0177237 | A1 | 7/2012 | Shukla et al. | |
| 2012/0294450 | A1 | 11/2012 | Ozcan | |
| 2013/0044904 | A1 | 2/2013 | Margalit | |
| 2013/0121500 | A1 | 5/2013 | Lamb et al. | |
| 2013/0121509 | A1 * | 5/2013 | Hsu | H04R 19/005 381/104 |
| 2013/0202119 | A1 | 8/2013 | Thiede | |
| 2016/0345104 | A1 * | 11/2016 | Margalit | H04R 1/24 |
| 2016/0360320 | A1 * | 12/2016 | Margalit | H04R 19/005 |
| 2016/0360321 | A1 * | 12/2016 | Margalit | H04R 7/10 |
| 2017/0006386 | A1 * | 1/2017 | Margalit | B81B 3/0021 |

FOREIGN PATENT DOCUMENTS

| | | | |
|---|---|---|---|
| EP | 2381289 | A1 | 10/2011 |
| JP | S6262700 | A | 3/1987 |
| JP | 2004349815 | A | 12/2004 |
| JP | 2004363967 | A | 12/2004 |
| JP | 2005184365 | A | 7/2005 |
| JP | 2005354582 | A | 12/2005 |
| JP | 2007005872 | A | 1/2007 |
| JP | 2007124449 | A | 5/2007 |
| JP | 2007312019 | A | 11/2007 |
| JP | 2008048312 | A | 2/2008 |
| JP | 2008182583 | A | 8/2008 |
| JP | 2012216898 | A | 11/2012 |
| KR | 1020050054648 | A | 6/2005 |
| WO | 9812589 | A1 | 3/1998 |
| WO | 173934 | A2 | 10/2001 |

OTHER PUBLICATIONS

"Capacitive Micromachined Ultrasonic Transducers (CMUTs)", Retrieved on Apr. 4, 2016 from the Internet at <URL: https://web.archive.org/web/20120126104159/http://www.me.gatech.edu/mist/cmut.htm>, pp. 4.

"Discover the Remarkable Novel Way to Transmit Sound", Retrieved on Mar. 28, 2016 from the Internet at <URL: https://web.archive.org/web/20120911234401/http://www.parametricsound.com/Technology.php>, pp. 4.

"Electrostatic Loudspeaker", Retrieved on Apr. 4, 2016 from the Internet at <URL:https://web.archive.org/web/20130828183848/http://en.wikipedia.org/wiki/Electrostatic_loudspeaker>, last modified on Feb. 27, 2013, pp. 6.

"First Major Innovation in Audio Speakers in Nearly 80 Years!", Audio Pixels Limited, Retrieved on Apr. 4, 2016 from the Internet at <URL:https://web.archive.org/web/20140125163627/http://www.audiopixels.com.au/index.cfm/technology/>, pp. 3.

"Hilbert Transform", Wikipedia, Retrieved on Mar. 28, 2016 from the Internet at <URL:https://web.archive.org/web/20131205110139/http://en.wikipedia.org/wiki/Hilbert_transform>, last modified on Dec. 4, 2013, pp. 17.

"ICsense Designs Asic for World's First Mems Speaker—Audio Pixels Limited and Icsense Enter Strategic Engagement to Support Production of Digital Mems Based Speaker Chip", Retrieved on Nov. 6, 2014 from the Internet at <URL:http://www.icsense.com/NEWS%3A%20Audiopixels>, posted on Oct. 9, 2013, pp. 2.

"Investor Video Presentation", Audio pixel Limited, Retrieved on Nov. 10, 2014 from the Internet at <URL:http://www.audiopixels.com.au/index.cfm/investor/video-presentation/>.

"Microelectromechanical Systems", Wikipedia, Retrieved on Apr. 4, 2016 from the Internet at <URL:https://web.archive.org/web/20131226230521/http://en.wikipedia.org/wiki/Microelectromechanical_systems>, last modified Nov. 28, 2013, pp. 12.

"Single-sideband Modulation," Retrieved on Mar. 28, 2016 from the Internet at <URL:https://web.archive.org/web/20131217204859/http://en.wikipedia.org/wiki/Single-sideband_modulation>, last modified on Nov. 12, 2013, pp. 9.

"Sound from Ultrasound", Wikipedia, Retrieved on Mar. 28, 2016 from the Internet at <URL: https://web.archive.org/web/20130829134301/http://en.wikipedia.org/wiki/Sound_from_ultrasound>, last modified on Jun. 27, 2013, pp. 10.

Rick Daniell, "Digital Loudspeakers—Part 1", YouTube, Retrieved on Nov. 7, 2014 from the Internet at <URL: https://www.youtube.com/watch?v=VgeUUMvdPel>, Published on Apr. 29, 2012, pp. 2.

Brett M. Diamond, "Digital Sound Reconstruction Using Arrays of CMOS-MEMS Microspeakers", Electrical and Computer Engineering, 2002, pp. 1-60.

Extended European Search Report for European Patent Application No. 11870957.5 (PCT/US2011/04783), dated Apr. 14, 2015.

(56) References Cited

OTHER PUBLICATIONS

Extended European Search Report for European Patent Application No. 15200544.3, dated Feb. 19, 2016.
International Search Report and Written Opinion of the International Searching Authority, International application No. PCT/US2011/047833, dated Nov. 28, 2011.
International Search Report and Written Opinion of the International Searching Authority, International application No. PCT/US2014/015438, dated Nov. 7, 2014.
International Search Report and Written Opinion of the International Searching Authority, International application No. PCT/US2014/015439, dated Oct. 29, 2015.
International Search Report and Written Opinion of the International Searching Authority, International application No. PCT/US2014/015440, dated Oct. 27, 2015.
International Search Report and Written Opinion of the International Searching Authority, International application No. PCT/US2014/015441, dated Oct. 29, 2015.
Eino Jakku et al., "The Theory of Electrostatic Forces in a Thin Electret (MEMS) Speaker", Proceedings IMAPS Nordic 2008 Helsingor, Sep. 14-16, 2008, pp. 95-100.
Brian D. Jensen et al., "Shaped Comb Fingers for Tailored Electromechanical Restoring Force", Journal of Microelectromechanical Systems, Jun. 25, 2003, pp. 373-383, vol. 12, No. 3.
Anatol Khilo et al., "Broadband Linearized Silicon Modulator", Optics Express, Feb. 23, 2011, pp. 4485-4500, vol. 19, No. 5.
Rob Legtenberg et al., "Comb-Drive Actuators for Large Displacements", Journal of Micromechanics and Microengineering, 1996, pp. 320-329, vol. 6.
Isaac Leung, "Sony to Help Develop Next-generation MEMS-based Speakers", Retrieved on Apr. 4, 2016 from the Internet at <URL: https://web.archive.org/web/20120327134931/http://www.electronicsnews.com.au/features/sony-to-help-develop-next-generation-mems-based-sp>, posted on Jul. 8, 2011, pp. 2.
Nguyen, C., "MEMS Comb-Drive Actuators", Microfabrication Technology, 2010, pp. 3.
M. Olfatnia et al., "Note: An Asymmetric Flexure Mechanism for Comb-Drive Actuators", Review of Scientific Instruments, 2012, pp. 116105-1-116105-3, vol. 83, Issue 11.
Mohammad Olfatnia et al., "Large Stroke Electrostatic Comb-Drive Actuators Enabled by a Novel Flexure Mechanism", Journal of Microelectromechanical Systems, Apr. 2013, pp. 483-494, vol. 22, No. 2.
Alexander A Trusov et al., "Capacitive Detection in Resonant MEMS with Arbitrary Amplitude of Motion", Journal of Micromechanics and Microengineering, Aug. 2007, pp. 1583-1592, vol. 17.
Tristan T. Trutna et al., "An Enhanced Stability Model for Electrostatic Comb-Drive Actuator Design", Proceedings of the ASME 2010 International Design Engineering Technical Conferences & Computers and Information in Engineering Conference IDETC/CIE, Aug. 15-18, 2010.
Wenjing Ye et al., "Optimal Shape Design of an Electrostatic Comb Drive in Microelectromechanical Systems", Journal of Microelectromechanical Systems, Mar. 1998, pp. 16-26, vol. 7, No. 1.
Masahide Yoneyama et al., "The Audio Spotlight: An Application of Nonlinear Interaction of Sound Waves to a New Type of Loudspeaker Design", Journal of the Acoustical Society of America, May 1983, pp. 1532-1536, vol. 73, No. 5.

* cited by examiner

MEMS-BASED STRUCTURE FOR PICO SPEAKER

CROSS-REFERENCE TO RELATED APPLICATION

The present application is a U.S. national stage filing under 35 U.S.C. § 371 of International Application PCT/US2014/015438, filed Feb. 8, 2014 and entitled "MEMS-BASED STRUCTURE FOR PICO SPEAKER." The International Application, including any appendices or attachments thereof, is hereby incorporated by reference in its entirety.

BACKGROUND

Unless otherwise indicated herein, the approaches described in this section are not prior art to the claims in this application and are not admitted to be prior art by inclusion in this section.

Microelectromechanical systems, or MEMS, is a technology that includes miniaturized mechanical and electromechanical elements, devices, and structures that may be produced using batch micro-fabrication or micro-machining techniques associated with the integrated circuit industry. The various physical dimensions of MEMS devices can vary greatly, for example from well below one micron to as large as the millimeter scale. In addition, there may be a wide range of different types of MEMS devices, from relatively simple structures having no moving elements, to extremely complex electromechanical systems with multiple moving elements under the control of integrated microelectronics. Such devices may include microsensors, microactuators, and microelectronics. Microsensors and microactuators may be categorized as "transducers," which are devices that may convert energy from one form to another. In the case of microactuators, a MEMS device may typically convert an electrical signal into some form of mechanical actuation.

SUMMARY

In accordance with at least some embodiments of the present disclosure, a microelectromechanical system (MEMS) device that comprises a first movable element and a second movable element is disclosed. The first movable element may be positioned in a first plane, formed from a first layer of a semiconductor substrate, and configured to oscillate along a first directional path substantially orthogonal to the first plane. The second movable element may be formed from a second layer of the semiconductor substrate that is a different layer than the first layer of the semiconductor substrate.

In accordance with at least some embodiments of the present disclosure, a MEMS device comprises an acoustic pipe, a first movable element, and a second movable element. The acoustic pipe is configured to conduct an ultrasonic acoustic signal along a first directional path. The first movable element is positioned on a first end of the acoustic pipe, formed from a first layer of a semiconductor substrate, and configured to generate the ultrasonic signal into the acoustic pipe. The blind element is formed from a second layer of the semiconductor substrate, includes one or more apertures, and is positioned on a second end of the acoustic pipe, wherein the second layer is a different layer than the first layer and the second end is opposite the first end. The second movable element is disposed outside the acoustic pipe and is formed from a third layer of the semiconductor substrate, wherein the third layer of the semiconductor substrate is a different layer than the first layer or the second layer.

In accordance with at least some embodiments of the present disclosure, a method to operate a MEMS device comprises generating an ultrasonic acoustic signal along a first directional path in an acoustic pipe using a first movable element that is formed from a first layer of a semiconductor substrate, conducting the ultrasonic acoustic signal via an acoustic pipe to a second movable element that is formed from a second layer of a semiconductor substrate that is a different layer than the first layer of the semiconductor substrate, and modulating the ultrasonic acoustic signal with the second movable element to generate an audio signal.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE DRAWINGS

The foregoing and other features of the present disclosure will become more fully apparent from the following description and appended claims, taken in conjunction with the accompanying drawings. These drawings depict only several embodiments in accordance with the disclosure and are, therefore, not to be considered limiting of its scope. The disclosure will be described with additional specificity and detail through use of the accompanying drawings.

DETAILED DESCRIPTION

Figure 1:
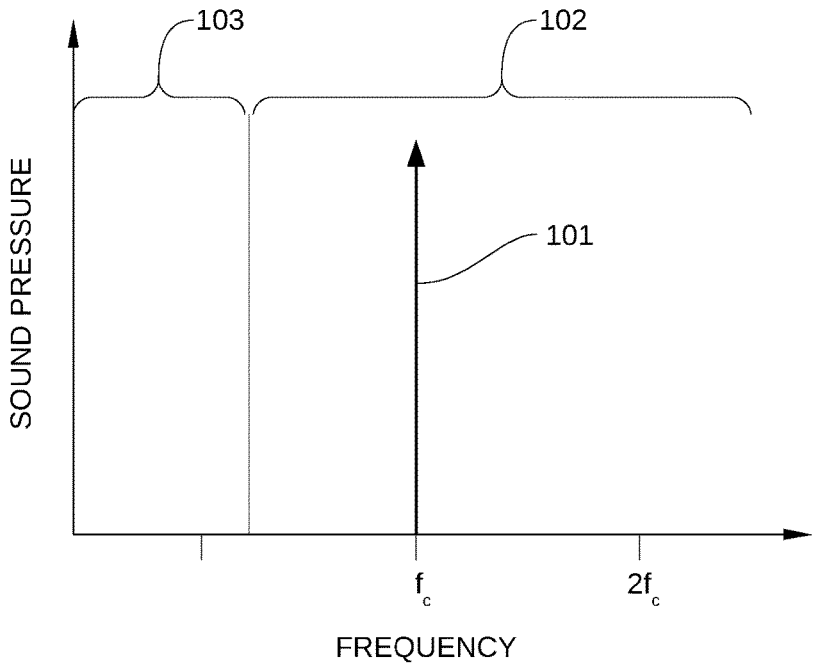
FIG. 1 schematically illustrates an example ultrasonic signal generated by a microelectromechanical system (MEMS) based audio speaker system.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. The aspects of the disclosure, as generally described herein, and illustrated in the Figures, can be arranged, substituted, combined, and designed in a wide variety of different configurations, all of which are explicitly contemplated and made part of this disclosure.

Loudspeaker design has changed little in nearly a century. A loudspeaker (or "speaker") is an electroacoustic transducer that produces sound in response to an electrical signal input. The electrical signal causes a vibration of the speaker cone in relation to the electrical signal amplitude. The resulting pressure change is the sound heard by the ear. In traditional speakers, the sound level is related to the square of the frequency. Consequently, speakers for producing low-frequency sounds may be larger and more powerful than speakers for producing higher-frequency sounds. It is for this reason that small tweeters may be commonly used for high-frequency audio signals and large subwoofers may be used for generating low-frequency audio signals. According to embodiments of the disclosure, a microelectromechanical systems (MEMS) structure may be configured as a speaker for generating audio signals.

MEMS technology is used for a wide variety of miniaturized mechanical and electro-mechanical devices. However, the small size of MEMS devices has mostly precluded the use of MEMS technology for audio speaker applications, since the frequency of sound emitted by a micron-scale oscillating membrane is generally in the ultrasonic regime. Some MEMS acoustic modulators may be used to create audio signals from a high frequency acoustic source, such as a MEMS-based audio speaker system. Specifically, an audible audio signal may be created by generating an ultrasonic signal with a MEMS oscillation membrane or a piezoelectric transducer, and then modulating the ultrasonic signal with an acoustic modulator, such as a MEMS shutter element. Because the ultrasonic signal may act as an acoustic carrier wave and the acoustic modulator may superimpose an input signal thereon by modulating the ultrasonic signal, the resultant signal generated by the MEMS-based audio speaker system may be a function of the frequency difference between the ultrasonic signal and the input signal. In this way, acoustic signals can be generated by a MEMS-based audio speaker system in the audible range and as low as the sub-100 Hz range, despite the very small size of such a speaker system.

FIG. 1 schematically illustrates an example ultrasonic signal 101 generated by the above-described MEMS-based audio speaker system. As shown, ultrasonic signal 101 may be located at the carrier frequency $f_C$ in the ultrasound region 102 of the sound frequency spectrum, and not in the audible region 103 of the sound frequency spectrum. The audible region 103 may generally include the range of human hearing, extending from about 20 Hz to about 20 kHz, and the ultrasound region 102 may include some or all frequencies higher than about 20 kHz.

Figure 2:
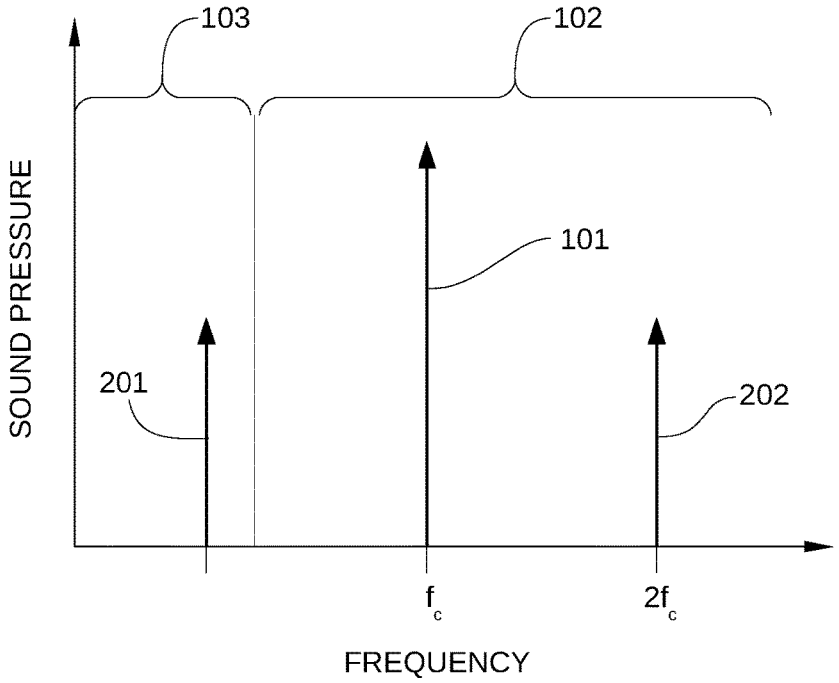
FIG. 2 schematically illustrates examples of a low frequency modulated sideband and a high frequency modulated sideband, which may be generated when the ultrasonic signal of FIG. 1 is amplitude modulated with an acoustic modulator in the MEMS-based audio speaker system.

FIG. 2 schematically illustrates examples of a low frequency modulated sideband 201 and high frequency modulated sideband 202, which may be generated when ultrasonic signal 101 is amplitude modulated with an acoustic modulator in the above-described MEMS-based audio speaker system. Low frequency modulated sideband 201 and high frequency modulated sideband 202 may be harmonic signals that are each functions of the modulation frequency $f_m$, where the modulation frequency $f_m$ may be, for example, the frequency of modulation of the MEMS shutter element or other acoustic modulator of the MEMS-based audio speaker system. Specifically, low frequency modulated sideband 201 and high frequency modulated sideband 202 may each be functions of the frequency difference between the carrier frequency $f_C$ and the modulation frequency $f_m$. High frequency modulated sideband 202 may be located in ultrasound region 102 and therefore may not be audible. In contrast, low frequency modulated sideband 201 may be located in audible region 103, and may represent an audible output signal from the MEMS-based audio speaker system. Thus, an audible signal can be generated by a MEMS-based audio speaker system.

Briefly stated, a MEMS-based audio speaker system according to embodiments of the present disclosure, may include one or more planar oscillation elements configured to generate an ultrasonic acoustic signal and one or more movable sound-obstruction elements, referred to herein as shutter elements. Each of the one or more shutter elements may include a portion configured to obscure an opening that is positioned to receive the ultrasonic acoustic signal generated by the one or more planar oscillation elements. By alternately obscuring and revealing the opening at modulation frequency $f_m$, the ultrasonic acoustic signal can be modulated so that an audio signal is generated, such as low frequency modulated sideband 201 in FIG. 2. Stated another way, a shutter element can be used to implement a modulation function on an acoustic carrier signal (that is for example at carrier frequency $f_c$) to generate an audio signal. Thus, given an appropriate modulation function and a suitably configured shutter element, a target acoustic output signal for the MEMS-based audio speaker system can be generated.

MEMS devices may typically include a plurality of layers that facilitate operation of the MEMS device such as electrical conduction layers, electrical insulation layers, and others. However, MEMS devices may generally include only a single functional layer, which is the material layer from which the moving element or elements of a MEMS device may be formed. For instance, a MEMS-based micromirror array used for digital projection may include thousands or even millions of adjustable MEMS micromirror elements that are each individually controlled to electrostatically deflect about a respective hinge mechanism. So while the MEMS substrate on which the MEMS micromirror elements are formed may include various material layers, each of the MEMS micromirrors is formed from the same material layer on the MEMS substrate.

In the case of a MEMS-based pico speaker, using a MEMS substrate with a single functional layer may be problematic in that an element of the pica speaker configured to generate an acoustic carrier signal may be a planar element formed from a layer of the MEMS substrate, and therefore may be oriented parallel to the plane of the substrate. Such orientation of a planar sound-generating device necessarily directs the acoustic carrier signal perpendicular to the plane of the MEMS substrate and directly away from the functional layer of the MEMS substrate. Consequently, forming a shutter element from this functional layer in a configuration that positions the shutter element to receive and modulate the acoustic carrier signal can be extremely complex and/or impossible to manufacture.

In light of the issues described above with some MEMS-based audio speaker systems, this disclosure is generally drawn, inter alia, to methods, apparatus, systems, and devices, related to MEMS devices that addresses at least some of these issues.

According to embodiments of the disclosure, a MEMS-based audio speaker system may include a first movable element, such as a planar oscillation element, formed from a first layer of a semiconductor substrate, and a second movable element, such as a shutter element, formed from a second layer of the semiconductor substrate. The first movable element may be configured to oscillate along a first directional path substantially orthogonal to the plane of the semiconductor substrate to generate an ultrasonic acoustic signal. The second movable element may be configured to oscillate along a directional path that is substantially parallel to the first directional path in order to modulate the ultrasonic acoustic signal such that an audio signal is generated. An embodiment of one such MEMS-based audio speaker system is illustrated in FIGS. 3 and 4.

Figure 3:
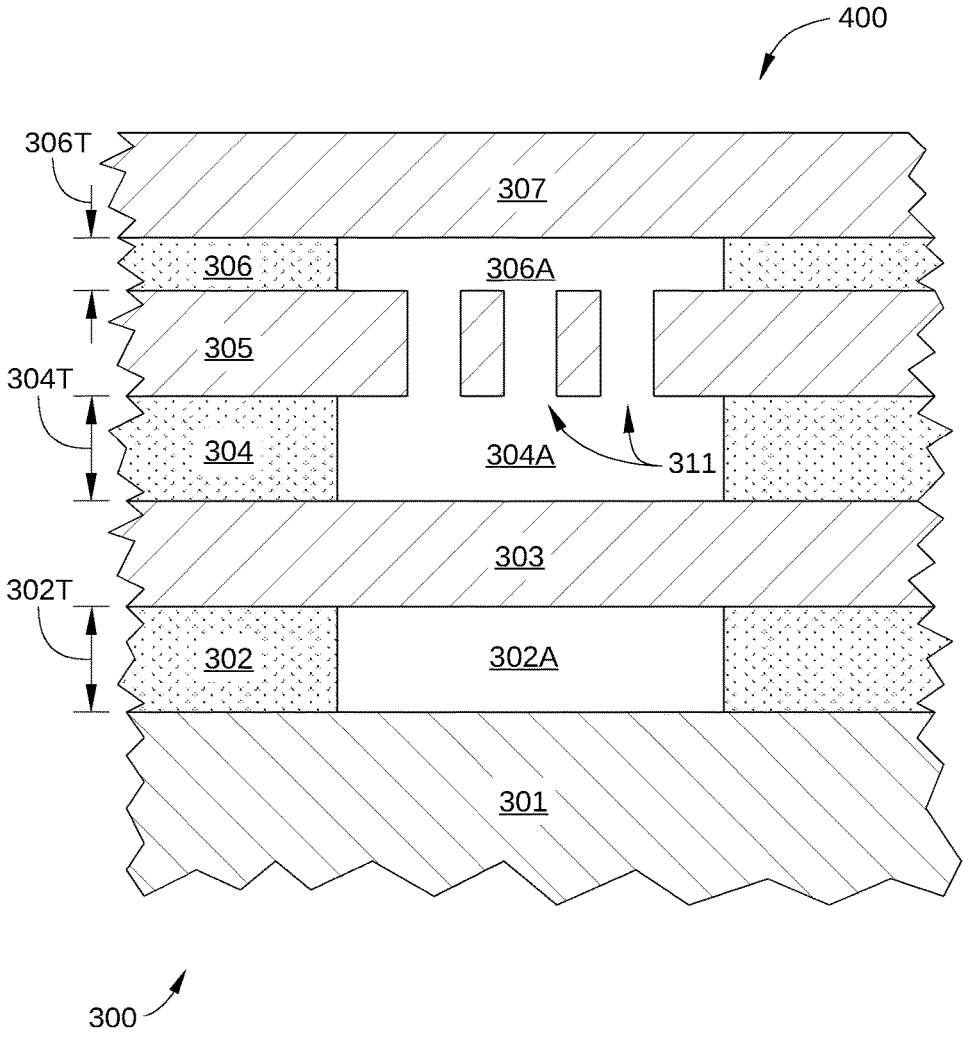
FIG. 3 is partial cross-sectional view of a semiconductor substrate configured with multiple functional layers, according to an embodiment of the disclosure.
Figure 4:
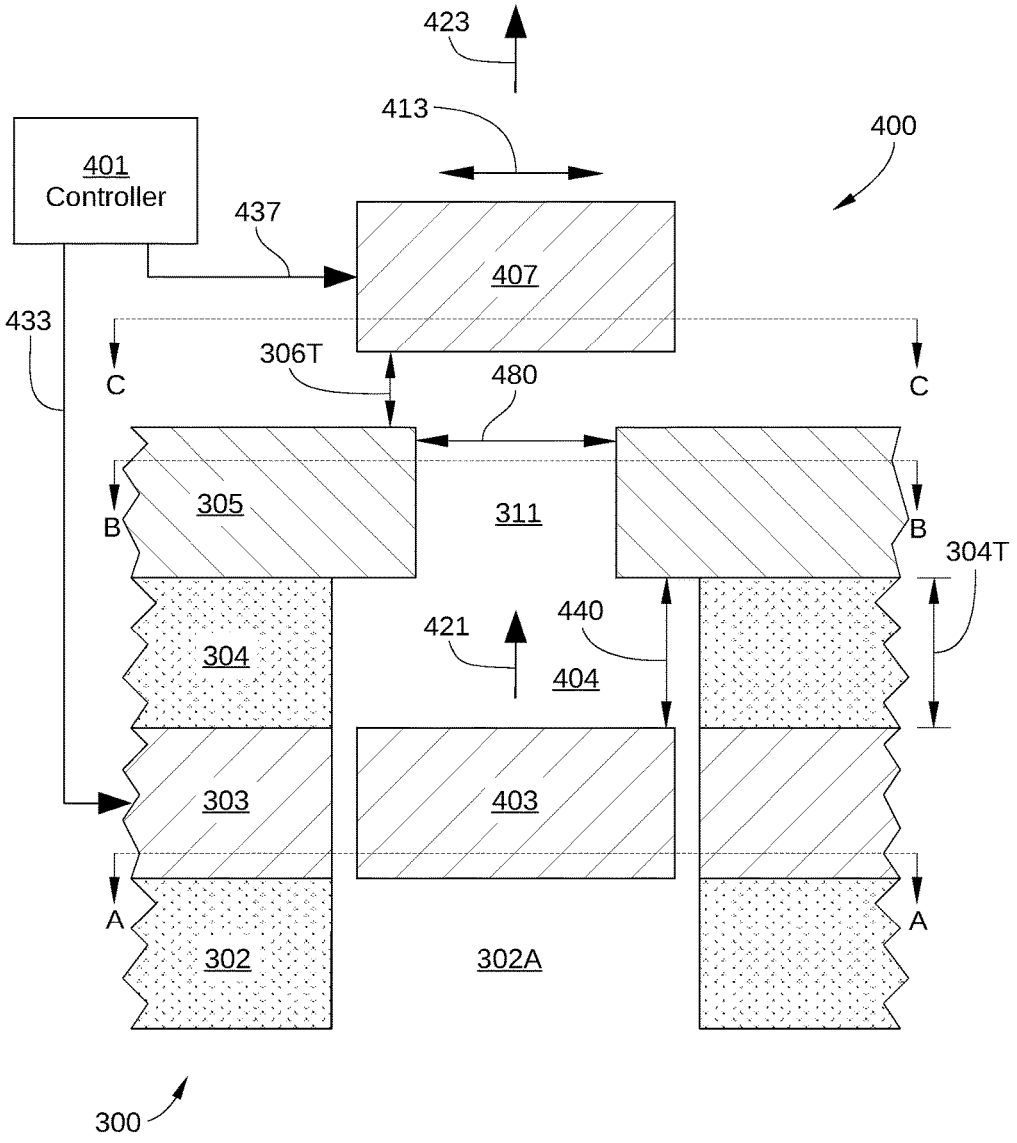
FIG. 4 is a cross-sectional view of an example embodiment of a pico speaker system formed from MEMS substrate illustrated in FIG. 3.

FIG. 3 is a partial cross-sectional view of a semiconductor substrate 300 configured with multiple functional layers, according to an embodiment of the disclosure. Semiconductor substrate 300 may be a MEMS substrate from which a pico speaker system 400 (described below in conjunction with FIG. 4) can be fabricated. Thus, in some embodiments, MEMS substrate 300 may include a bulk substrate 301, a bottom electrical insulation layer 302, a first functional layer 303, a center electrical insulation layer 304, an electrically conductive layer 305, a top electrical insulation layer 306 and a second functional layer 307, all arranged as shown. Selective removal of portions of bottom electrical insulation layer 302, center electrical insulation layer 304, and top electrical insulation layer 306 forms free volumes 302A, 304A, and 306A, respectively.

Bulk substrate 301 may be a handle wafer or other semiconductor substrate on which a plurality of MEMS devices can be fabricated simultaneously. Bulk substrate 301 may include a doped or undoped semiconductor material, such as single crystal silicon, that is suitable for the fabrication of logic and/or memory devices, so that logic and control circuitry may be formed on semiconductor substrate 300 and incorporated into pico speaker system 400. In addition, bulk substrate 301 may provide mechanical support during fabrication for logic circuitry and MEMS devices formed thereon.

Bottom electrical insulation layer 302, center electrical insulation layer 304, and top electrical insulation layer 306 can be any electrical insulator suitable for use in a MEMS device, including silicon oxide ($SiO_x$), silicon nitride ($Si_3N_4$), or one or more of various polymers, such as an epoxy, a silicone, benzocyclobutene (BCB), solidified SU8 (an epoxy-based photoresist), etc. Various techniques may be used for the deposition or other formation of each of bottom electrical insulation layer 302, center electrical insulation layer 304, and top electrical insulation layer 306, depending on what specific material is used to form each.

Bottom electrical insulation layer 302 has a thickness 302T that may be selected to allow displacement into free volume 302A of an oscillation membrane formed from first functional layer 303. In addition, thickness 302T may be selected to provide at least a target electrical isolation between bulk substrate 301 and first functional layer 303. Thus, in some embodiments, thickness 302T may be on the order of about one to ten microns, for example when an operating voltage between bulk substrate 301 and first functional layer 303 is on the order of 5- to 50 volts. Similarly, center electrical insulation layer 304 has a thickness 304T that may be selected to allow displacement into free volume 304A of the oscillation membrane formed from first functional layer 303. In addition, thickness 304T may be selected to provide at least a target electrical isolation between first functional layer 303 and electrically conductive layer 305. In some embodiments, thickness 304T may be on the order of about one to five microns when an operating voltage between first functional layer 303 and electrically conductive layer 305 is on the order of about 5-50 volts. Top electrical insulation layer 306 has a thickness 306T that may be selected so that the formation of free volume 306A allows horizontal displacement of a shutter element formed from second functional layer 307. Thus, in some embodiments, thickness 306T may be on the order of about one to five microns, for example when a shutter element driven by a comb drive is formed from second functional layer 307. In addition, thickness 306T may be selected to provide at least a target electrical isolation between electrically conductive layer 305 and second functional layer 307.

First functional layer 303 and second functional layer 307 may be layers formed on or attached to bulk substrate 301 from which movable elements of pico speaker system 400 are fabricated. Because the movable elements of pico speaker system 400 may generally include electrostatically actuated components, first functional layer 303 and second functional layer 307 may include one or more electrically conductive materials, such as silver (Ag), aluminum (Al), copper (Cu), and/or silicon (Si) and/or other material(s) or combination(s) thereof. In some embodiments, first functional layer 303 and second functional layer 307 may each be formed as a layer of electrically conductive material deposited or otherwise formed/located on bottom electrical insulation layer 302 and top electrical insulation layer 306, respectively. Alternatively, in some embodiments, wafer-level bonding techniques may be used in the formation of one or both of first functional layer 303 and second functional layer 307. For example, first functional layer 303 and/or second functional layer 307 may be formed on a donor wafer or substrate with the movable elements of pico speaker system 400 fabricated thereon, bonded onto semiconductor substrate 300 (the target wafer), and then separated from the donor wafer or substrate.

Electrically conductive layer 305 may be a layer formed on or attached to bulk substrate 301 in which one or more apertures 311 are formed. Apertures 311, described in greater detail below in conjunction with FIG. 4, may be configured to allow passage of an ultrasonic acoustic signal generated by an oscillation membrane formed from first functional layer 303. Apertures 311 may be formed using various lithographic patterning and etching techniques, depending on the specific materials included in electrically conductive layer 305. In some embodiments, electrically conductive layer 305 may include one or more electrically conductive materials, such as silver (Ag), aluminum (Al), copper (Cu), and/or silicon (Si) and/or other material(s) or combination(s) thereof, and may be formed as layer of electrically conductive material deposited or otherwise formed/located on center electrical insulation layer 304. In some embodiments, electrically conductive layer 305 may be configured as two electrically conductive layers separated by an electrical insulation layer.

FIG. 4 is a cross-sectional view of an example embodiment of pico speaker system 400 formed from MEMS substrate 300 described above. Pica speaker speaker system 400 may be realized as a MEMS structure formed from the various layers and/or thin films formed on MEMS substrate 300, and may include two functional layers. Thus, pico speaker system 400 may be a compact acoustic generator capable of producing acoustic signals throughout the audible portion of the sound frequency spectrum, for example from the sub-100 Hz range to 20 kHz and above. As such, pico speaker system 300 may be well-suited for mobile devices and/or any other applications in which size, sound fidelity, or energy efficiency are beneficial. Pico speaker system 400 may include a controller 401, an oscillation membrane 403, an acoustic pipe 404, one or more apertures 311, and a MEMS shutter 407, all arranged as shown. For clarity, a single aperture 311 is depicted in FIG. 4, however, in some embodiments, pica speaker system 400 may include an array of multiple apertures 311 formed in electrically conductive layer 305, such as parallel slotted openings or a grid of square or rectangular openings or other shape/arrangement.

Controller 401 may be configured to control the various active elements of pico speaker system 400 so that a resultant acoustic signal 423 is produced by pico speaker system 400 that is substantially similar to a target audio output. For example, controller 401 may be configured to generate and supply oscillation signal 433 (which oscillates) to oscillation membrane 403 so that oscillation membrane 403 may generate an ultrasonic acoustic carrier signal 421. Controller 401 may also be configured to generate and supply a modulation signal 437 to MEMS shutter 407. Modulation signal 437 is described in greater detail below. Controller 401 may include logical circuitry incorporated in pico speaker system 400 and/or a logic chip or other circuitry that is located remotely from pico speaker system 400. Alternatively or additionally, some or all operations of controller 401 may be performed by a software construct or a module (which may include software, hardware, or combination of both) that is loaded into or coupled to such circuitry or is executed by one or more processor devices associated with pico speaker system 400. In some embodiments, the logic circuitry of controller 401 may be fabricated in semiconductor substrate 300.

Oscillation membrane 403 may be formed in first functional layer 303 and may be configured to oscillate and generate ultrasonic acoustic carrier signal 421, where ultrasonic acoustic carrier signal 421 may be an ultrasonic acoustic signal of a fixed frequency. In some embodiments, ultrasonic acoustic carrier signal 421 may have a fixed frequency of at least about 50 kHz, for example. In some embodiments, ultrasonic acoustic carrier signal 421 may have a fixed frequency that is significantly higher than 50 kHz, for example 100 kHz or more. Furthermore, in some embodiments, oscillation membrane 403 may have a very small form factor, for example on the order of 10 s or 100 s of microns. Oscillation membrane 403 may be oriented so that ultrasonic acoustic carrier signal 421 is directed toward MEMS shutter 407, as shown in FIG. 4.

A target oscillation may be induced in oscillation membrane 403 to produce ultrasonic acoustic carrier signal 421 via any suitable electrostatic MEMS actuation scheme. For example, in some embodiments, controller 401 may provide an oscillating voltage signal 433 that is applied to oscillation membrane 403. Oscillation membrane 403 is electrically isolated from a reference surface, therefore displacement of oscillation membrane 403 results. The reference surface may be any electrically conductive surface that is grounded and disposed proximate oscillation membrane 403. In the embodiment illustrated in FIG. 4, electrically conductive layer 305 serves as a reference surface. In other embodiments, bulk substrate 301 may act as such a surface. One embodiment of oscillation membrane 403 is depicted in FIG. 5.

Figure 5:
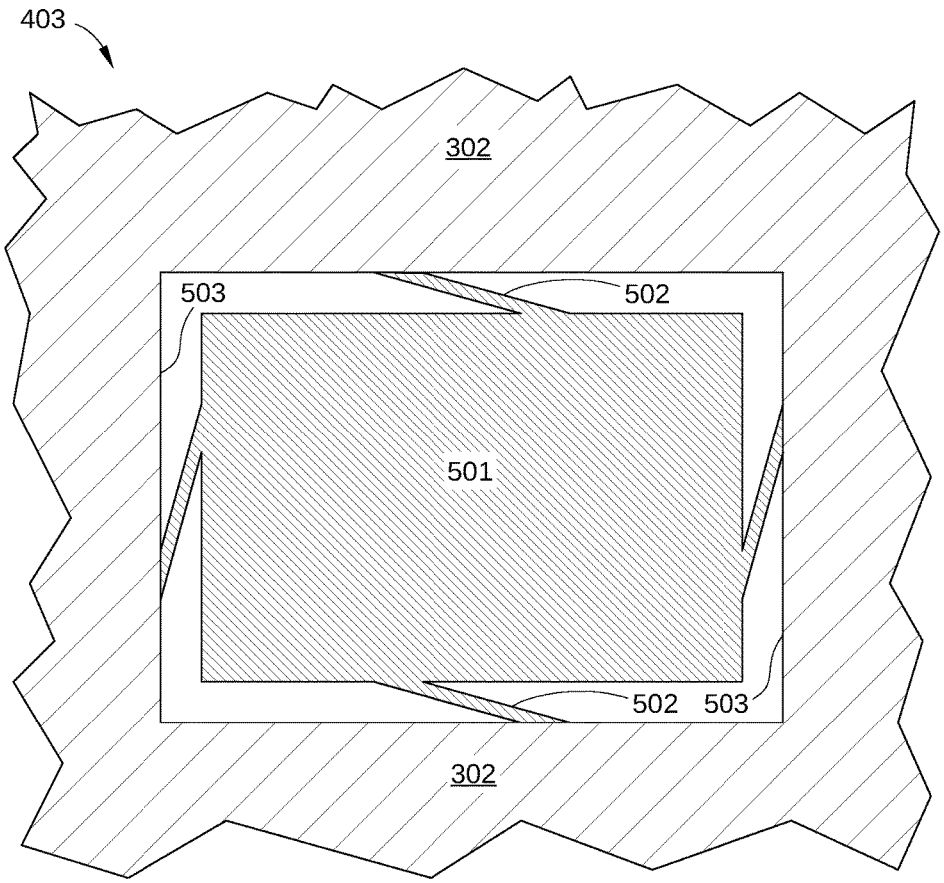
FIG. 5 illustrates a cross-sectional view of an oscillation membrane at section AA in FIG. 4.

FIG. 5 illustrates a cross-sectional view of oscillation membrane 403 at section A-A in FIG. 4. As shown, oscillation membrane 403 may include a membrane body 501 and at least one spring 502 that couple(s) membrane body 501 elastically to walls 503. Membrane body 501, springs 502, and walls 503 may be micro-machined from first functional layer 302 using various patterning and etching techniques, depending on the specific material makeup of first functional layer 302. In some embodiments, oscillation membrane 403 may be configured to oscillate at a particular target frequency, such as the frequency of ultrasonic acoustic carrier signal 421. In such embodiments, the mass of membrane body 501 and the dimensions of springs 502 may be selected so that the harmonic frequency of oscillation membrane 403 is substantially equal to the frequency of ultrasonic acoustic carrier signal 421.

Returning now to FIG. 4, acoustic pipe 404 may be formed by the removal of a portion of center electrical insulation layer 304 using suitable patterning and etching techniques, and may be configured to conduct ultrasonic acoustic signal 421 from oscillation membrane 403 to aperture 311. In some embodiments, reflections of ultrasonic acoustic signal 421 in acoustic pipe 404 may be reduced by configuring acoustic pipe 404 to have a maximum or near-maximum (or otherwise large) acoustic impedance at or near the frequency of ultrasonic acoustic signal 421. The acoustic impedance of a duct (the ratio of acoustic pressure to acoustic volume flow) may generally be a strong function of frequency, and can vary by several orders of magnitude over a relatively narrow range of frequencies. In such embodiments, the free area of aperture or apertures 311 can be selected to reduce acoustic impedance of acoustic pipe 404 at the frequency of ultrasonic acoustic signal 421.

Alternatively, in some embodiments, acoustic pipe 404 may be configured as a resonant cavity. Specifically, a length 440 of acoustic pipe 404 may be selected to be an integral multiple of one half the wavelength of a sound wave at the frequency of ultrasonic acoustic signal 421. Length 440 can be selected by thickness 304T of center electrical insulation layer 304. In such embodiments, an accumulation of acoustic energy may occur during operation in acoustic pipe 404 due to the harmonic reflections of ultrasonic acoustic signal 421 therein. Consequently, even though shutter element 407 may only allow elimination of a relatively small portion of the resonating acoustic energy from acoustic pipe 405, the resulting audio output signal 423 from pico speaker system 400 can be improved when acoustic pipe 404 is configured as a resonant cavity.

Aperture 311 may be formed in electrically conductive layer 305, and may have a width 480 on the order of 10 s or 100 s of microns. In such embodiments, electrically conductive layer 305 may be configured as a blind element, which is a structure positioned on an end of acoustic pipe 404 that generally prevents most acoustic energy in acoustic pipe 404 from exiting when at least partially covered or obscured by MEMS shutter 407. Furthermore, in some embodiments, aperture 311 may be configured as a plurality of openings formed in the blind element (electrically conductive layer 305) that can be at least partially (and in some embodiments totally) obscured by MEMS shutter 407 rather than as a single opening as shown in FIG. 4. As noted above, in some embodiments, the dimensions of aperture 311 may be selected to increase acoustic impedance of acoustic pipe 404 at the frequency of ultrasonic acoustic signal 421.

Figure 6:
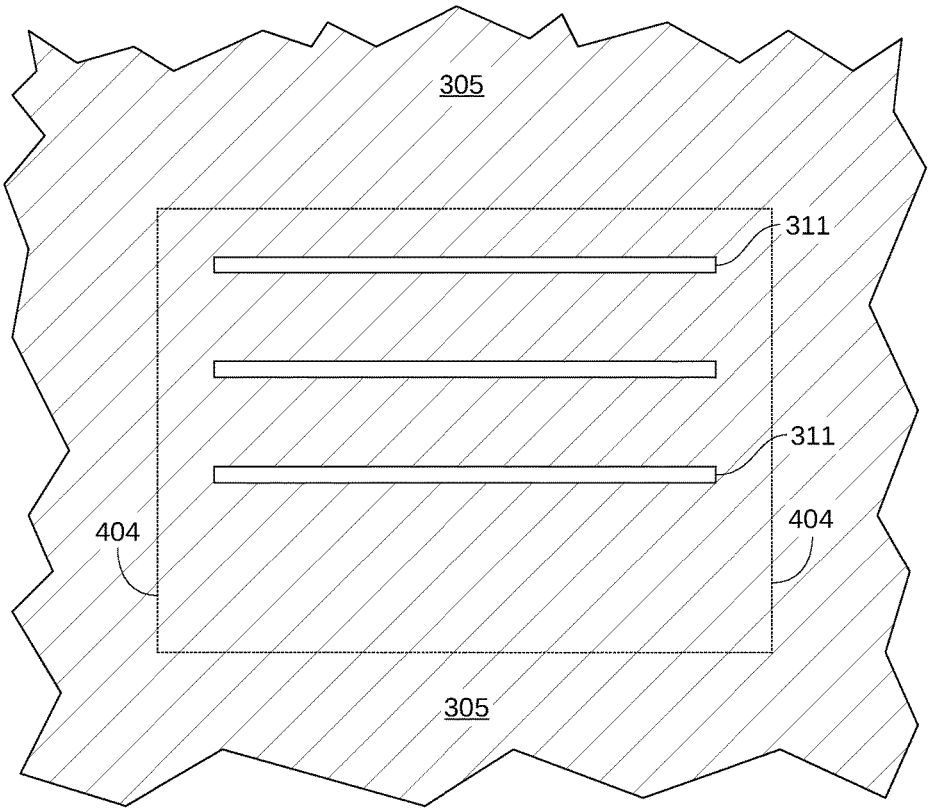
FIG. 6 is a cross-sectional view of an electrically conductive layer at section BB in FIG. 4.

FIG. 6 is a cross-sectional view of electrically conductive layer 305 at section B-B in FIG. 4. As shown, electrically conductive layer 305 may be configured as a blind element that at least partially (and in some embodiments totally) covers acoustic pipe 404 except for apertures 311. Any other technically feasible configuration and shape of apertures 311 may instead be formed in electrically conductive layer 305, including a single aperture 311 and an array of multiple apertures 311. Each of apertures 311 may be positioned to align with a corresponding portion of MEMS shutter 407 (shown in FIG. 4) when MEMS shutter 407 is in the closed position. Therefore, when MEMS shutter 407 is in the closed position, at least some of apertures 311 may be totally or at least partially obscured by MEMS shutter 407.

Returning to FIG. 4, MEMS shutter 407 may be a micro-machined shutter element that is formed from second functional layer 307 of semiconductor substrate 300 and may be configured to modulate ultrasonic acoustic carrier signal 421 to generate audio output signal 423. For example, MEMS shutter 407 may be configured to modulate ultrasonic acoustic carrier signal 421 according to modulation signal 437 from controller 401 to generate audio output signal 423. Thus, MEMS shutter 407 may multiply ultrasonic acoustic carrier signal 421, which may be a sinusoidal function, by first modulation signal 437, which may also be a sinusoidal function. The result of such a multiplication may be a sum of frequencies and a difference of frequencies, where the sum of frequencies corresponds to twice the modulation signal (for example high frequency modulated sideband 202 in FIG. 2) and the difference of frequencies corresponds to the audible audio signal (for example low frequency modulated sideband 201 in FIG. 2). Therefore, when modulation signal 437 is based on a suitable modulation function, audio output signal 423 may be produced that is substantially similar to a target audio output for pico speaker system 400.

In the embodiment illustrated in FIG. 4, MEMS shutter 407 may be configured to translate in a direction substantially orthogonal to the direction in which ultrasonic carrier signal 421 propagates. In such embodiments, MEMS shutter 407 may be positioned substantially parallel to oscillation membrane 403. Any type of technically feasible MEMS actuator may be used to convert modulation signal 437 into a displacement 413 of MEMS shutter 407. Specifically, any MEMS actuators may be used that 1) can provide sufficient magnitude of displacement 413 to at least partially obscure and reveal aperture 311, and 2) has an operational bandwidth that includes the frequency of ultrasonic carrier signal 421. Furthermore, the dimensions of MEMS shutter 407 and magnitude of displacement 413 may be selected such that aperture 311 can be completely covered by MEMS shutter 407 to provide a high or otherwise increased level of sound pressure modulation. It is noted that as thickness 306T is decreased, modulation depth of MEMS shutter 407 may be improved. In some embodiments, a MEMS comb drive may be used to convert modulation signal 437 into displacement 413 of MEMS shutter 407. One embodiment of a configuration of MEMS shutter 407 that includes a MEMS comb drive is depicted in FIG. 7.

Figure 7:
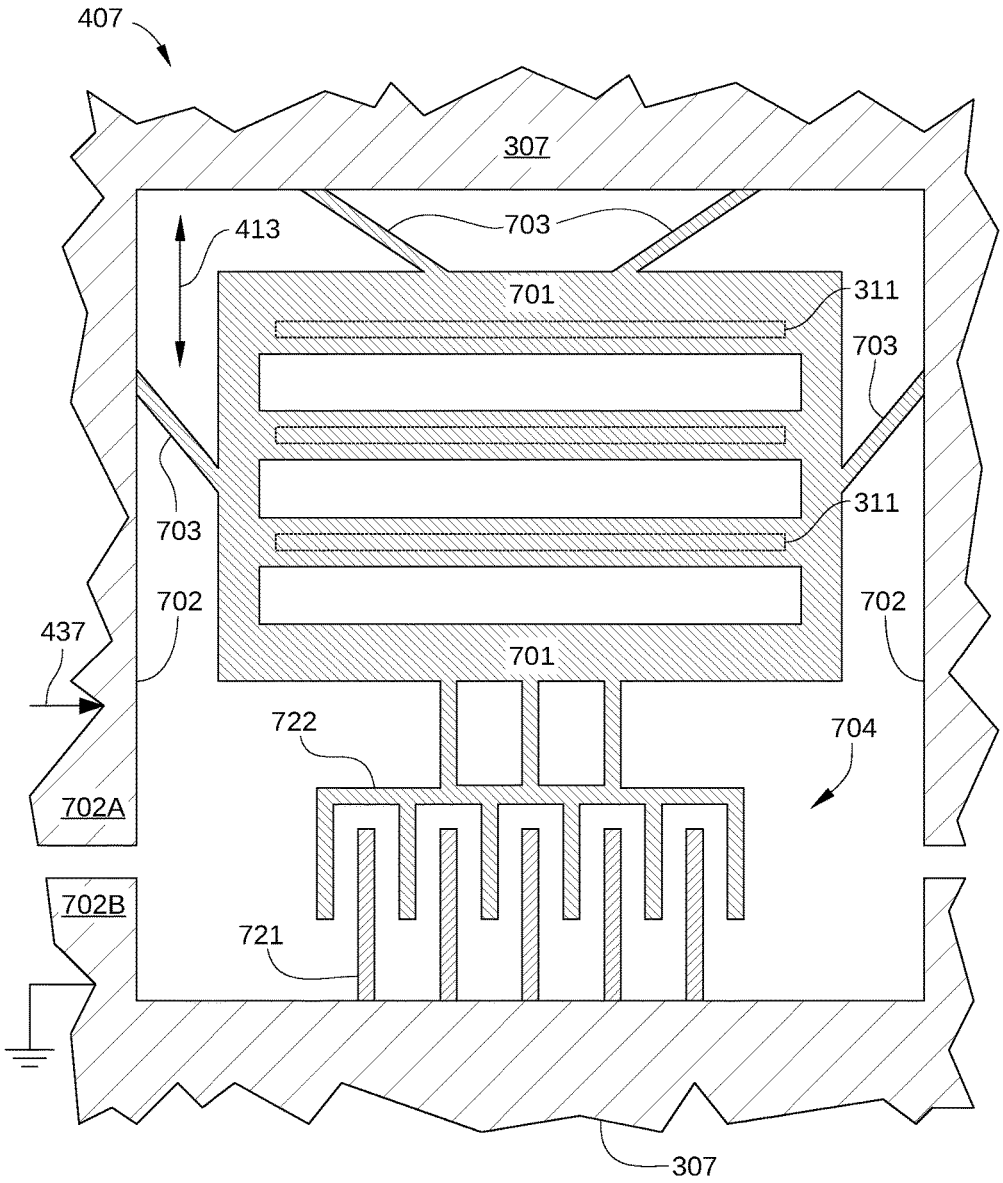
FIG. 7 illustrates a cross-sectional view of a MEMS shutter at section CC in FIG. 4 according to one embodiment.

FIG. 7 illustrates a cross-sectional view of MEMS shutter 407 at section C-C in FIG. 4 according to one embodiment. MEMS shutter 407 may include a shutter body 701, a frame 702, at least one spring 703, and an actuator 704, all arranged as shown. Shutter body 701, frame 702, springs 703, and actuator 704 may be micro-machined from second functional layer 307 using various lithographic patterning and etching techniques, depending on the specific materials included in second functional layer 307. Shutter body 701 may be flexibly coupled to frame 702 by at least one spring (including multiple springs in an embodiment) 703. Shutter body 701 may also be coupled to actuator 704, which is depicted as a comb drive in the embodiment illustrated in FIG. 7. In other embodiments, actuator 704 may be any other technically feasible MEMS actuator.

In some embodiments, actuator 704 may include a static comb 721 and a moving comb 722 that are electrically isolated from each other. In such embodiments, moving comb 722 and shutter body 701 can be electrostatically actuated toward static comb 721 by the application of an electric field between static comb 721 and moving comb 722. To implement such electrostatic isolation, frame 702 may be separated into a charged portion 702A and a grounded portion 702B (or vice versa), where charged portion 702A is electrically coupled to moving comb 722 and shutter body 701, while grounded portion 702B is electrically coupled to static comb 721. Charged portion 702A may be configured to receive modulation signal 437 from controller 401 and grounded portion 702B may be electrically coupled to electrical ground. Alternatively, grounded portion 702B may function as a floating ground.

As shown in FIG. 7, shutter body 701 may be configured to at least partially obscure apertures 311 when in a closed state and reveal apertures 311 when in an open state. Thus, audio output signal 423 may be generated by MEMS shutter 407 by the motion of MEMS shutter 407 along displacement 413 when ultrasonic acoustic carrier signal 421 passes from acoustic pipe 404 and through apertures 311. As MEMS shutter 407 moves along displacement 413 as defined by modulation signal 437, apertures 311 are alternately obscured and revealed by MEMS shutter 407 and ultrasonic acoustic carrier signal 421 is modulated to generate audio output signal 423.

Figure 8:
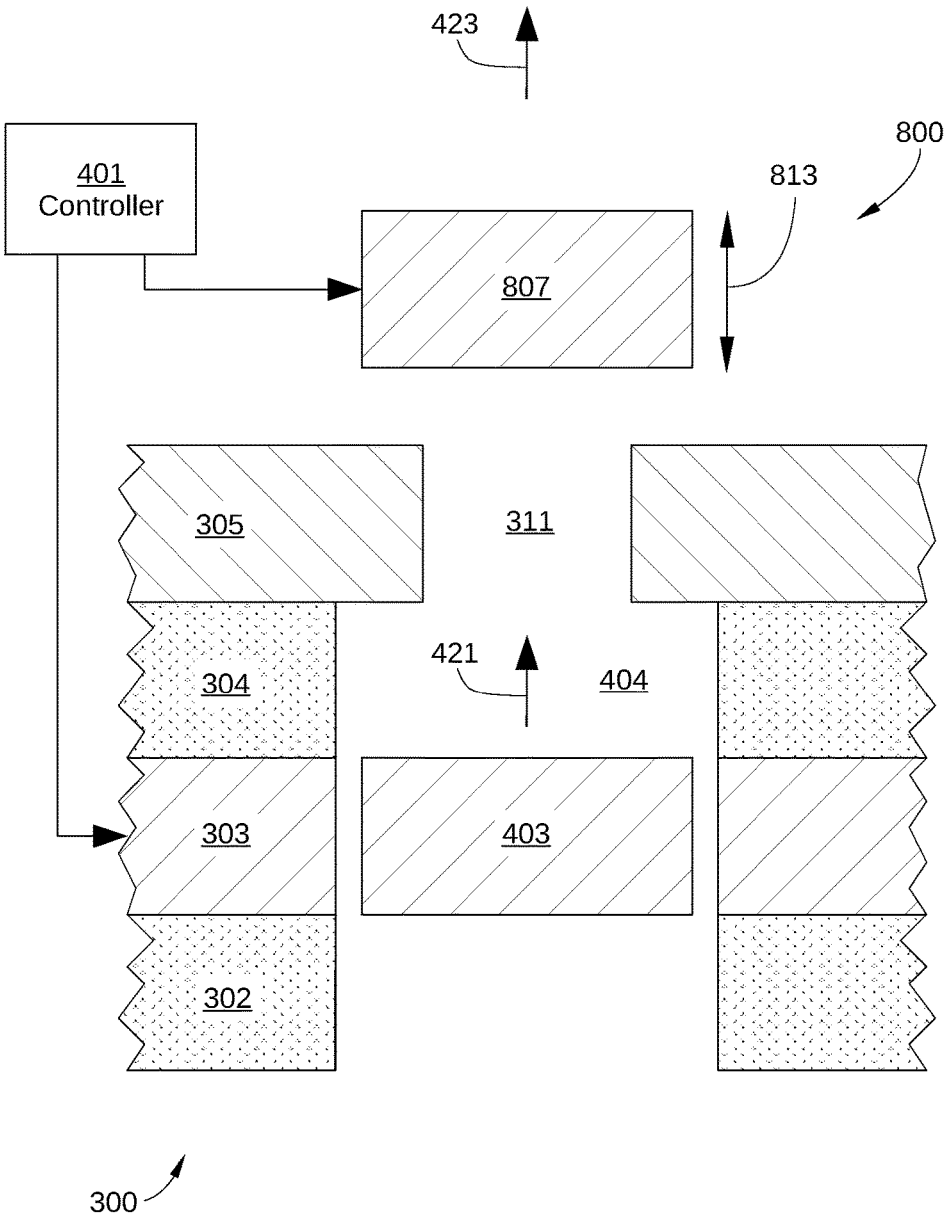
FIG. 8 is a cross-sectional view of a pico speaker system, arranged in accordance with at least some embodiments of the present disclosure.

Other configurations of MEMS shutters and oscillation membranes arranged in a pico speaker system may also fall within the scope of the present disclosure. For example, in some embodiments MEMS shutter 407 may be configured to translate in a direction substantially parallel to the direction in which ultrasonic acoustic carrier signal 421 propagates from oscillation membrane 403. One such embodiment is illustrated in FIG. 8. FIG. 8 is a cross-sectional view of a pico speaker system 800, arranged in accordance with at least some embodiments of the present disclosure. Pico speaker system 800 may be substantially similar in configuration and operation to pico speaker system 400 in FIG. 4, except that pico speaker system 800 may include at least one MEMS shutter that is configured to translate in a direction substantially parallel to the direction in which an ultrasonic carrier signal generated by an oscillation membrane propagates. In contrast, pico speaker system 400 in FIG. 4 includes MEMS shutters that are configured to translate in a direction substantially orthogonal to the direction in which an ultrasonic carrier signal is generated.

For example, in the embodiment illustrated in FIG. 8, pico speaker system 800 may include a MEMS shutter 807, which is configured to translate in a direction substantially parallel to ultrasonic acoustic carrier signal 421. In this way, MEMS shutter 807 is configured to undergo a time-varying displacement 813 in response to modulation signal 437. In pico speaker system 800, the time-varying displacement 813 of MEMS shutter 807 may modulate the amplitude of ultrasonic acoustic carrier signal 421 to generate audio output signal 423. This modulation occurs because movement toward aperture 311 by MEMS shutter 807 substantially obscures or covers aperture 311, while movement away from aperture 311 by MEMS shutter 807 substantially uncovers or reveals aperture 311, which allows more acoustic energy to exit acoustic pipe 404.

In comparison with pica speaker system 400 in FIG. 4, the amplitude modulation of ultrasonic acoustic carrier signal 421 in pico speaker system 800 may provide enhanced modulation depth and may implement substantially less surface area of a MEMS substrate to be manufactured. This is because there may be no need for a comb drive or other external mechanical actuator to translate MEMS shutter 807 with time-varying displacement 813. Instead, MEMS shutter 807 can be configured as an electrostatic actuator, where an electrical voltage between MEMS shutter 807 and electrically conductive layer 305 causes MEMS shutter 807 to move relative to electrically conductive layer 305. Thus, when an electrical bias is applied to MEMS shutter 807 while electrically conductive layer 305 is electrically grounded to provide a reference for the electric field, MEMS shutter 807 is pulled toward electrically conductive layer 305 and substantially blocks aperture 311. Furthermore, MEMS shutter 807 can be coupled to an adjacent portion of electrically conductive layer 305 with a spring structure. Thus, when MEMS shutter 807 is pulled towards aperture 311 in response to the application of a bias to MEMS shutter 807, the spring structure is in tension, and when the bias is reduced or reversed in polarity, the spring tension pulls MEMS shutter 807 away from aperture 311.

Figure 9:
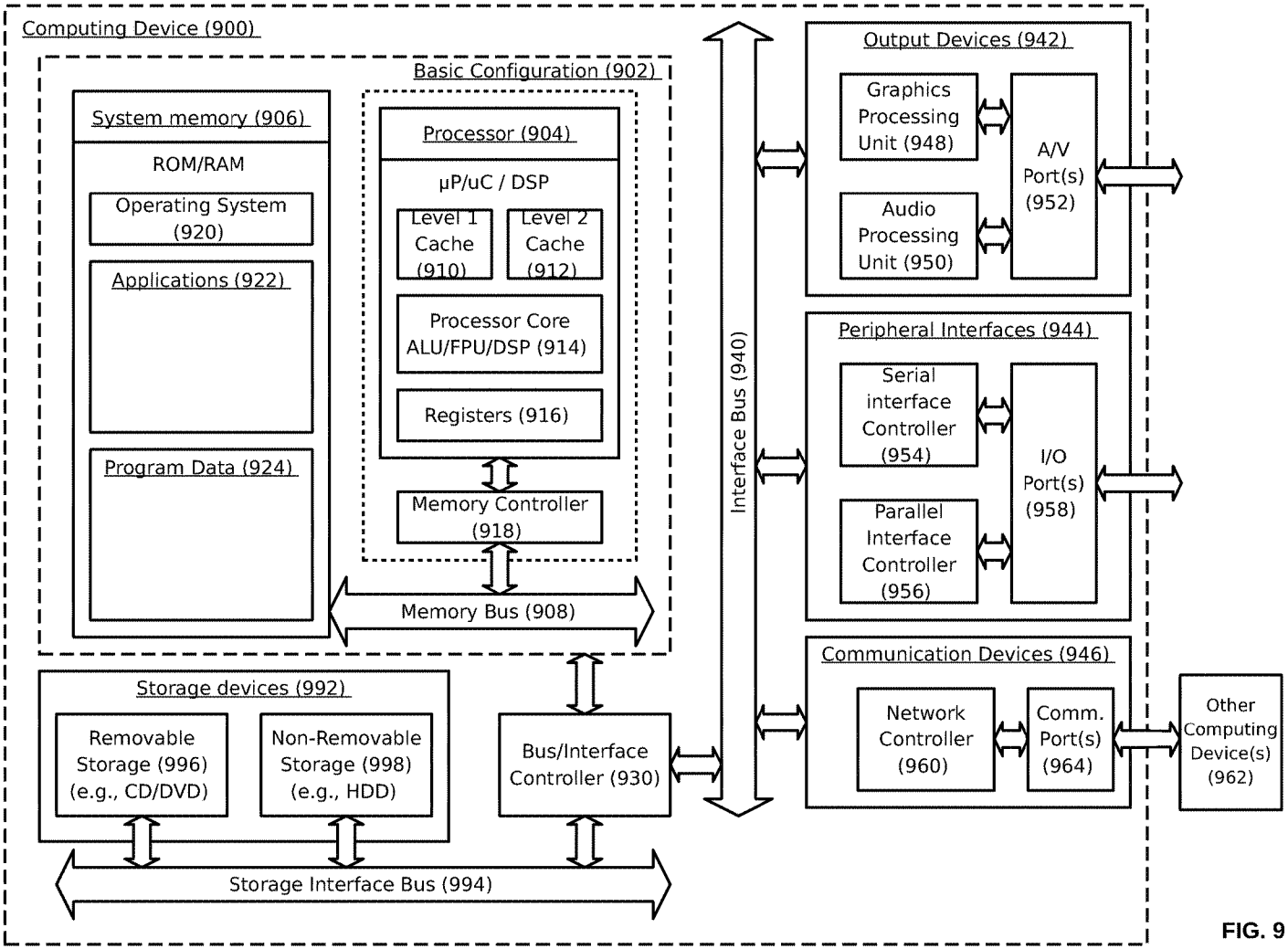
FIG. 9 is a block diagram illustrating an example computing device in which one or more embodiments of the present disclosure may be implemented.

FIG. 9 is a block diagram illustrating an example computing device 900 that may be used in conjunction with a pico speaker system as described herein, in accordance with at least some embodiments of the present disclosure. In a very basic configuration 902, computing device 900 typically includes one or more processors 904 and a system memory 906. A memory bus 908 may be used for communicating between processor 904 and system memory 906.

Depending on the desired configuration, processor 904 may be of any type including but not limited to a microprocessor (μP), a microcontroller (μC), a digital signal processor (DSP), or any combination thereof. Processor 904 may include one more levels of caching, such as a level one cache 910 and a level two cache 912, a processor core 914, and registers 916. An example processor core 914 may include an arithmetic logic unit (ALU), a floating point unit (FPU), a digital signal processing core (DSP Core), or any combination thereof. Processor 904 may include programmable logic circuits, such as, without limitation, field-programmable gate arrays (FPGAs), patchable application-specific integrated circuits (ASICs), complex programmable logic devices (CPLDs), and others. An example memory controller 918 may also be used with processor 904, or in some implementations memory controller 918 may be an internal part of processor 904. In some embodiments, controller 401 described above with respect to FIGS. 4 and 8 can be implemented by processor 904.

Depending on the desired configuration, system memory 906 may be of any type including but not limited to volatile memory (such as RAM), non-volatile memory (such as ROM, flash memory, etc.) or any combination thereof. System memory 906 may include an operating system 920, one or more applications 922, and program data 924. Program data 924 may include data that may be useful for operation of computing device 900. In some embodiments, application 922 may be arranged to operate with program data 924 on operating system 920. In some embodiments, application 922 and/or operating system 920 may be executed by or work concurrently with processor 904 to provide either or both oscillation signal 433 or modulation signal 437. This described basic configuration 902 is illustrated in FIG. 9 by those components within the inner dashed line.

Computing device 900 may have additional features or functionality, and additional interfaces to facilitate communications between basic configuration 902 and any required devices and interfaces. For example, a bus/interface controller 990 may be used to facilitate communications between basic configuration 902 and one or more data storage devices 992 via a storage interface bus 994. Data storage devices 992 may be removable storage devices 996, non-removable storage devices 998, or a combination thereof. Examples of removable storage and non-removable storage devices include magnetic disk devices such as flexible disk drives and hard-disk drives (HDDs), optical disk drives such as compact disk (CD) drives or digital versatile disk (DVD) drives, solid state drives (SSDs), and tape drives to name a few. Example computer storage media may include volatile and nonvolatile, removable and non-removable media implemented in any method or technology for storage of information, such as computer readable instructions, data structures, program modules, or other data.

System memory 906, removable storage devices 996 and non-removable storage devices 998 are examples of computer storage media. Computer storage media includes, but is not limited to, RAM, ROM, EEPROM, flash memory or other memory technology, CD-ROM, digital versatile disks (DVDs) or other optical storage, magnetic cassettes, magnetic tape, magnetic disk storage or other magnetic storage devices, or any other medium which may be used to store the desired information and which may be accessed by computing device 900. Any such computer storage media may be part of computing device 900.

Computing device 900 may also include an interface bus 940 for facilitating communication from various interface devices (e.g., output devices 942, peripheral interfaces 944, and communication devices 946) to basic configuration 902 via bus/interface controller 930. Example output devices 942 include a graphics processing unit 948 and an audio processing unit 950, which may be configured to communicate to various external devices such as a display or speakers via one or more A/V ports 952. Such speakers may include one or more embodiments of pico speaker systems as described herein. Example peripheral interfaces 944 include a serial interface controller 954 or a parallel interface controller 956, which may be configured to communicate with external devices such as input devices (e.g., keyboard, mouse, pen, voice input device, touch input device, etc.) or other peripheral devices (e.g., printer, scanner, etc.) via one or more I/O ports 958. An example communication device 946 includes a network controller 960, which may be arranged to facilitate communications with one or more other computing devices 962 over a network communication link, such as, without limitation, optical fiber, Long Term Evolution (LTE), 3G, WiMax, via one or more communication ports 964.

The network communication link may be one example of a communication media. Communication media may typically be embodied by computer readable instructions, data structures, program modules, or other data in a modulated data signal, such as a carrier wave or other transport mechanism, and may include any information delivery media. A "modulated data signal" may be a signal that has one or more of its characteristics set or changed in such a manner as to encode information in the signal. By way of example, and not limitation, communication media may include wired media such as a wired network or direct-wired connection, and wireless media such as acoustic, radio frequency (RF), microwave, infrared (IR) and other wireless media. The term computer readable media as used herein may include both storage media and communication media.

Computing device 900 may be implemented as a portion of a small-form factor portable (or mobile) electronic device such as a cell phone, a personal data assistant (PDA), a personal media player device, a wireless web-watch device, a personal headset device, an application specific device, or a hybrid device that include any of the above functions. Computing device 900 may also be implemented as a personal computer including both laptop computer and non-laptop computer configurations.

As described herein, embodiments of the present disclosure include a MEMS-based audio speaker system formed from a semiconductor substrate having multiple functional layers. The MEMS-based audio speaker system may include a first movable element, such as a planar oscillation element, formed from a first functional layer of the semiconductor substrate, and a second movable element, such as a shutter element, formed from a second functional layer of the semiconductor substrate. Thus both movable elements of the pico speaker system can be formed as part of the same MEMS device. One feature of such embodiments is that the pico speaker system can be implemented with a very small form factor. An additional feature is that fabrication of such a pico speaker system is greatly simplified when both movable elements are formed in a single MEMS device.

The foregoing detailed description has set forth various embodiments of the devices and/or processes via the use of block diagrams, flowcharts, and/or examples. Insofar as such block diagrams, flowcharts, and/or examples contain one or more functions and/or operations, it will be understood by those within the art that each function and/or operation within such block diagrams, flowcharts, or examples can be implemented, individually and/or collectively, by a wide range of hardware, software, firmware, or virtually any combination thereof. In one embodiment, several portions of the subject matter described herein may be implemented via Application Specific Integrated Circuits (ASICs), Field Programmable Gate Arrays (FPGAs), digital signal processors (DSPs), or other integrated formats. However, those skilled in the art will recognize that some aspects of the embodiments disclosed herein, in whole or in part, can be equivalently implemented in integrated circuits, as one or more computer programs running on one or more computers (e.g., as one or more programs running on one or more computer systems), as one or more programs running on one or more processors (e.g., as one or more programs running on one or more microprocessors), as firmware, or as virtually any combination thereof, and that designing the circuitry and/or writing the code for the software and or firmware would be well within the skill of one of skill in the art in light of this disclosure. In addition, those skilled in the art will appreciate that the mechanisms of the subject matter described herein are capable of being distributed as a program product in a variety of forms, and that an illustrative embodiment of the subject matter described herein applies regardless of the particular type of signal bearing medium used to actually carry out the distribution. Examples of a signal bearing medium include, but are not limited to, the following: a recordable type medium such as a floppy disk, a hard disk drive, a Compact Disc (CD), a Digital Video Disk (DVD), a digital tape, a computer memory, etc.; and a transmission type medium such as a digital and/or an analog communication medium (e.g., a fiber optic cable, a waveguide, a wired communications link, a wireless communication link, etc.).

Those skilled in the art will recognize that it is common within the art to describe devices and/or processes in the fashion set forth herein, and thereafter use engineering practices to integrate such described devices and/or processes into data processing systems. That is, at least a portion of the devices and/or processes described herein can be integrated into a data processing system via a reasonable amount of experimentation. Those having skill in the art will recognize that a typical data processing system generally includes one or more of a system unit housing, a video display device, a memory such as volatile and non-volatile memory, processors such as microprocessors and digital signal processors, computational entities such as operating systems, drivers, graphical user interfaces, and applications programs, one or more interaction devices, such as a touch pad or screen, and/or control systems including feedback loops and control motors (e.g., feedback for sensing position and/or velocity; control motors for moving and/or adjusting components and/or quantities). A typical data processing system may be implemented utilizing any suitable commercially available components, such as those typically found in data computing/communication and/or network computing/communication systems.

The herein described subject matter sometimes illustrates different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled", to each other to achieve the desired functionality, and any two components capable of being so associated can also be viewed as being "operably couplable", to each other to achieve the desired functionality. Specific examples of operably couplable include but are not limited to physically mateable and/or physically interacting components and/or wirelessly interactable and/or wirelessly interacting components and/or logically interacting and/or logically interactable components.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

I claim:

1. A microelectromechanical system (MEMS) device, the device comprising:

a first movable element that is positioned in a first plane, formed from a first layer of a semiconductor substrate, and configured to oscillate along a first directional path substantially orthogonal to the first plane; and a second movable element that is formed from a second layer of the semiconductor substrate that is a different layer than the first layer of the semiconductor substrate, wherein the second movable element is configured to oscillate along a second directional path that is substantially parallel to the first directional path.

2. The MEMS device of claim 1, wherein the second movable element is positioned in a second plane that is substantially parallel to the first plane.

3. The MEMS device of claim 1, wherein the second movable element comprises a shutter portion configured to linearly translate along the second directional path.

4. The MEMS device of claim 1, wherein the second movable element comprises a comb drive configured to actuate along the second directional path.

5. The MEMS device of claim 1, wherein the first movable element comprises a membrane that is configured to generate an ultrasonic acoustic signal along the first directional path.

6. The MEMS device of claim 5, wherein the first movable element is electrically coupled to a voltage source.

7. The MEMS device of claim 5, wherein the second movable element comprises a shutter portion configured to modulate the ultrasonic acoustic signal such that an audio signal is generated.

8. The MEMS device of claim 7, wherein the shutter portion is configured to linearly translate along the second directional path.

9. The MEMS device of claim 8, wherein the second movable element further comprises a comb drive configured to actuate along the second directional path.

10. The MEMS device of claim 7, wherein the shutter portion is configured to translate in a direction substantially parallel to the first directional path.

11. The MEMS device of claim 10, wherein the second movable element is configured without an external mechanical actuator.

12. The MEMS device of claim 5, further comprising a blind element that is disposed between the first movable element and the second movable element, defines one or more apertures, is formed from a third layer of the semiconductor substrate that is a different layer than the first layer or the second layer, and is substantially separated from the first movable element and the second movable element, wherein the second movable element is configured to modulate the first ultrasonic acoustic signal by at least partially obscuring the one or more apertures.

13. The MEMS device of claim 1, wherein at least a portion of the second movable element is electrically coupled to a first voltage source.

14. The MEMS device of claim 13, wherein the first movable element is electrically coupled to a second voltage source and is electrically isolated from the portion of the second movable element that is electrically coupled to the first voltage source by at least one electrical insulation layer of the semiconductor substrate.

15. The MEMS device claim 14, further comprising a free volume adjacent to the second movable element that is configured to allow movement of the second movable element, wherein the free volume is formed by removal of a portion of an electrical insulation layer that is adjacent to the second layer of the semiconductor substrate.

16. The MEMS device of claim 15, wherein the second movable element comprises a shutter portion configured to linearly translate along the second directional path that is substantially parallel to the first directional path and wherein the electrical insulation layer that is adjacent to the second layer of the semiconductor substrate has a thickness that is no greater than about 10 microns.

17. The MEMS device of claim 1, further comprising a first free volume adjacent to a first side of the first movable element that is configured to allow movement of the first movable element along the first directional path, wherein the first free volume is formed by removal of a portion of a first electrical insulation layer of the semiconductor substrate.

18. The MEMS device of claim 17, further comprising a second free volume adjacent to a second side of the first movable element that is configured to allow movement of the first movable element along the first directional path, wherein the second free volume is formed by removal of a portion of a second electrical insulation layer of the semiconductor substrate.

19. The MEMS device of claim 18, wherein the first electrical insulation layer of the semiconductor substrate has a thickness that is no greater than about 20 microns and the second electrical insulation layer of the semiconductor substrate has a thickness that is no greater than about 20 microns.

20. A microelectromechanical system (MEMS) device, the device comprising:

an acoustic pipe configured to conduct an ultrasonic acoustic signal along a first directional path;

a first movable element that is positioned at a first end of the acoustic pipe, formed from a first layer of a semiconductor substrate, and configured to direct the ultrasonic signal into the acoustic pipe;

a blind element that is formed from a second layer of the semiconductor substrate, includes one or more apertures, and is positioned at a second end of the acoustic pipe, wherein the second layer is a different layer than the first layer and the second end is opposite to the first end; and a second movable element that is disposed outside the acoustic pipe and is formed from a third layer of the semiconductor substrate, wherein the third layer of the semiconductor substrate is a different layer than the first layer or the second layer, wherein the second movable element is configured to oscillate along a second directional path that is substantially parallel to the first directional path.

21. The MEMS device of claim 20, wherein the second movable element comprises a shutter portion configured to linearly translate along the second directional path that is substantially orthogonal to the first directional path.

22. The MEMS device of claim 20, wherein the second movable element comprises a shutter portion configured to linearly translate along the second directional path.

23. The MEMS device of claim 21, wherein the second movable element is configured to modulate the ultrasonic acoustic signal such that an audio signal is generated.

24. The MEMS device of claim 20, wherein the first movable element is configured to generate the ultrasonic signal at a fixed frequency and the acoustic pipe is configured to have a maximum acoustic impedance at the fixed frequency.

25. The MEMS device of claim 20, wherein the first movable element is configured to generate the ultrasonic signal at a fixed frequency and the acoustic pipe is configured to be a resonant cavity at the fixed frequency.

26. The MEMS device of claim 25, wherein the acoustic pipe has a length from the first end to the second end that is an integral multiple of one half of a wavelength of a sound wave at the fixed frequency.

27. A method to operate a microelectromechanical system (MEMS) device, the method comprising:

oscillating a first movable element along a first directional path to generate an ultrasonic acoustic signal;

conducting the ultrasonic acoustic signal along the first directional path via an acoustic pipe to a second movable element; and oscillating the second movable element along a second directional path that is substantially orthogonal or substantially parallel to the first directional path to modulate the ultrasonic acoustic signal and generate an audio signal.

28. The method of claim 27, wherein the ultrasonic acoustic signal has a wavelength that is two times a wavelength of the acoustic pipe divided by an integer value.

* * * * *